US007700886B2

(12) United States Patent
Ikeda

(10) Patent No.: US 7,700,886 B2
(45) Date of Patent: Apr. 20, 2010

(54) RUBBER KEY DEVICE

(75) Inventor: Akihiro Ikeda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 12/414,012

(22) Filed: Mar. 30, 2009

(65) Prior Publication Data

US 2009/0188781 A1 Jul. 30, 2009

Related U.S. Application Data

(62) Division of application No. 11/527,427, filed on Sep. 27, 2006, now abandoned.

(30) Foreign Application Priority Data

Sep. 30, 2005 (JP) ..... 2005-286457

(51) Int. Cl.
*H01H 9/26* (2006.01)

(52) U.S. Cl. ..... 200/5 R; 200/5 A

(58) Field of Classification Search ..... 200/310–315, 200/512–520, 5 A, 6 A, 5 R, 14, 18, 339, 200/5 B, 561
See application file for complete search history.

(56) References Cited

U.S. PATENT DOCUMENTS

| | | | | |
|---|---|---|---|---|
| 3,673,357 | A | 6/1972 | Molchan | |
| 5,089,677 | A * | 2/1992 | Satou | 200/339 |
| 5,584,380 | A | 12/1996 | Naitou | |
| 5,783,787 | A * | 7/1998 | Data | 200/5 R |
| 6,633,641 | B1 | 10/2003 | Mushika et al. | |
| 6,943,311 | B2 | 9/2005 | Miyako | |
| 7,030,324 | B2 | 4/2006 | Gotoh | |
| 7,417,199 | B2 | 8/2008 | Nielsen | |
| 2002/0003082 | A1 | 1/2002 | Janniere et al. | |
| 2003/0094359 | A1 | 5/2003 | Yanai et al. | |
| 2004/1016062 | | 8/2004 | Suzuki et al. | |

(Continued)

FOREIGN PATENT DOCUMENTS

CN 1417819 A 5/2003

(Continued)

OTHER PUBLICATIONS

European Search Report for Corresponding Application No. EP 06 25 4960, dated Jan. 25, 2007.

(Continued)

*Primary Examiner*—Renee S Luebke
*Assistant Examiner*—Lisa Klaus
(74) *Attorney, Agent, or Firm*—Scully, Scott, Murphy & Presser, P.C.

(57) ABSTRACT

A rubber key device is provide with a key top member, multiple rubber keys, a click feel generating mechanism and a load transmitting mechanism. When a depression area of the key top member is depressed by a user, the key top member is rotated to depress a top face of a rubber key via the load transmitting mechanism. The load transmitting mechanism transmits the load caused by the depression of the depression area to the top face of the corresponding rubber key such that the load is transmitted to only a substantially central portion of the top face of the corresponding one of the multiple rubber keys regardless of the depression amount of the depression area.

16 Claims, 10 Drawing Sheets

U.S. PATENT DOCUMENTS

| | | | |
|---|---|---|---|
| 2004/1025112 | | 12/2004 | Miyako |
| 2005/0126897 | A1 | 6/2005 | Stephens |
| 2005/0133347 | A1 | 6/2005 | Hein |
| 2007/0137993 | A1 | 6/2007 | Nielsen |

FOREIGN PATENT DOCUMENTS

| | | | |
|---|---|---|---|
| DE | 37 19 793 | A1 | 12/1988 |
| JP | SHO 59-005843 | | 1/1984 |
| JP | SHO 62-062729 | | 4/1987 |
| JP | SHO 63-112724 | | 7/1988 |
| JP | 2001-067982 | A | 3/2001 |
| JP | 2001-143554 | A | 5/2001 |
| JP | 2001-250455 | A | 9/2001 |
| JP | 2002-260496 | A | 9/2002 |
| JP | 2004-215178 | A | 7/2004 |

OTHER PUBLICATIONS

Japanese Notification of Reasons of Rejection, with English translation thereof, issued in Patent Application No. JP 2005-286457 dated on Jun. 24, 2008.

Chinese Office Action, with English Translation, issued in Chinese Patent Application No. CN 2006101418513 dated on Oct. 10, 2008.

* cited by examiner

RUBBER KEY DEVICE

CROSS-REFERENCE TO RELATED APPLICATIONS

This application is a Divisional of U.S. application Ser. No. 11/527,427, filed Sep. 27, 2006 now abandoned, claiming priority of Japanese Patent Application No. 2005-286457, filed Sep. 30, 2005, the entire contents of each of which are herein incorporated by reference.

BACKGROUND OF THE INVENTION

1. Technical Field

Aspects of the present invention relate to a rubber key device having a key top portion formed with an operation face, which is provided with a plurality of depression areas along its periphery, a rubber key being arranged on an opposite side of each depression area. When each depression area is depressed, the rubber key corresponding to the depression area is depressed. Aspects of the invention also relate to a portable terminal device and image processing device employing such a rubber key device.

2. Related Art

Conventionally, the rubber key device as described above is employed in various electronic devices such as a facsimile apparatus and a telephone. In such an electronic device, the rubber key is used as a multi-selection key used for selecting one of multiple candidate items. An example of such a device is disclosed in Japanese Patent Provisional Publication No. P2001-250455A (hereinafter, referred to as '455 publication).

As a concrete example of a device employing the rubber key device, a cordless handset of a facsimile apparatus or a telephone will be described with reference to FIG. 10, which schematically shows a configuration of the cordless handset 100 which is used in association with a main device (not shown).

As shown in FIG. 10, the cordless handset 100 is provided with an operation panel 108 which is provided with multiple keys such as numerical keys for inputting numerals and letters/symbols, four-direction key 106 for selecting one of multiple functions or items, a display 110 for displaying operation status of the operation panel 108, a communication status with an opponent when an audio communication is being performed, an earpiece 112 configured to output an audio message via a built-in speaker and a mouth piece 114 through which voice of the user is transmitted to a built-in microphone.

Surfaces (operation faces) of the multiple keys and four-direction key 106 provided to the operation panel 108 are respectively exposed to outside through openings that are formed at predetermined positions on a case 102. For example, for the four-direction key 106, a cross-shaped opening 104 is formed on the case 102, and the top surface (i.e., an operation surface) of the four-direction key 106 is exposed to outside through the opening 104.

As shown in FIG. 10, the four-direction key 106 is configured to have four depression areas (up, down, right and left in FIG. 10) along its peripheral, and the four depression areas are assigned with different functions or selective items, respectively. When one of the depression areas is depressed by a user, a function or a selective item assigned to the depressed area is selected.

Now, a rubber key device including a plurality of rubber keys for the four-direction key 106 of the cordless handset 100 will be described in detail, referring to FIGS. 11A and 11B. FIGS. 11A and 11B each shows a cross-sectional side view, taken along line A-A in FIG. 10, of the rubber key device employed in the cordless handset 100.

The cordless handset 100 is provided with a rubber key sheet 120. The rubber key sheet 120 is provided on a printed circuit board 116, and has rubber keys 123, 123, 123 and 123 corresponding to the up, down, right and left depression areas of the four-direction key 106. Among the four rubber keys 123, 133, etc., one corresponding to the up depression area of the four-direction key 106 has a cylindrical shape which is circular when viewed from the four-direction key 106 side. On a lower side (i.e., the printed circuit board 116 side) of the cylindrical rubber key, over an peripheral end thereof, a skirt portion 125 is formed, which is connected to a base portion 121. The rubber key 133 corresponding to the lower depression area of the four-direction key 106 in FIG. 10 has the similar structure, and is connected to the base portion 121 via the skirt portion 135 (see FIG. 11A). Although not shown, the rubber keys corresponding to the right and left depression areas of the four-direction key 106 have the same structure. The rubber keys 123, 133, etc., the skirt portions 125, 135, etc., and the base portion 121 are formed integrally using the same rubber member, and form the single rubber key sheet 120 as a whole.

The skirt portions 125 and 135 are intended to generate a so-called "click feel" when the corresponding rubber keys 123 and 133 are depressed. That is, the rubber keys 123 and 133 are elastically supported by the skirt portions 125 and 135, respectively, with respect to the base portion 121. If the rubber key 123 corresponding to the up depression area of the four depression areas is depressed toward the printed circuit board 116 side, the skirt portion 125 elastically deforms and the rubber key 123 moves toward the printed circuit board 116. The deformation of the skirt portion 125 generates the "click feel". With this configuration, when the user depresses the rubber key 123 (133) directly or indirectly, he/she feels the "click feel" generated by the deformation of the skirt portion 125 (135) and recognizes the key is fully depressed.

As above, if the user depresses the upper depression area of the four-direction key 106, as shown in FIG. 11B, the four-direction key 106 rotates counterclockwise (in direction Q in FIG. 11B) about a point P which is a point at which an end of the four-direction key 106 at a position opposite to the depressed area and the case 102 contact. Then, by a bottom surface 107 of the four-direction key 106, the upper surface of the rubber key 123 is depressed. Then, a movable contact 127 formed on a bottom surface of the rubber key 123 electrically contacts a fixed contact 129 formed on the printed circuit board 116.

SUMMARY OF THE INVENTION

The present invention is advantageous in that an improved rubber key device is provided. The improved rubber key device is configured to have a key top portion provided with an operation face including multiple depression areas, each of which is configured to provide adequate "click" feel when depressed. Aspects of the invention are further advantageous in that a mobile terminal or an image processing device is provided with the rubber key device which supplies sufficient "click" feel.

DESCRIPTION

General Overview

The following describes general aspects of the invention that may or may nor be included in various embodiments/modifications. Also, it is noted that various connections are set forth between elements in the following description. It is noted that these connections in general and, unless specified otherwise, may be direct or indirect and that this specification is not intended to be limiting in this respect.

According to aspects of the invention, there is provided a rubber key device for an apparatus having a case, which is provided with a key top member having an operation face, which is exposed to outside through an opening formed on the case, multiple depression areas to be depressed by a user being defined on the operation face, the multiple depression areas being arranged along a periphery of the operation face, multiple rubber keys arranged below the key top, top faces of the multiple rubber keys facing the back surface of the key top member at positions corresponding to the multiple operation areas, respectively, a click feel generating mechanism provided to each rubber key and configured to generate a click feel in response to depression of each rubber key by a certain degree, and a load transmitting mechanism provided between the back side of the key top member and the top face of each of the multiple rubber keys. When one of the multiple depression areas is depressed by the user, the key top member is rotated about a fulcrum which is defined to be located on center side with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion (i.e., a central portion of an area in the vicinity of the central portion) of the top face of the corresponding one of the multiple rubber keys regardless of the depression amount of the depression area.

Figure 9:
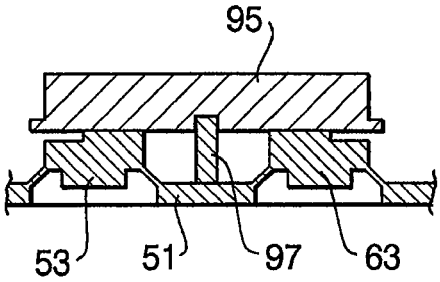
FIG. 9 is a cross-sectional side view of a rubber key device according to another modification.

In the rubber key device, the key top is rotated about a fulcrum. A position of the fulcrum depends on how the key top member is supported. For example, in the structure shown in FIGS. 11A and 11B, an opposite end with respect to the depressed depression area serves as the fulcrum. When the key top member is supported at its center by a supporting shaft or the like as shown in FIG. 9, the center of the key top member serves as the fulcrum.

When the key top rotates about the fulcrum, an area corresponding to the depressed depression area of the back surface of the key top member contacts the top face of the rubber key, and the rubber key receives the depressing load from the back surface of the key top. According to the structure shown in FIGS. 11A and 11B, when the back surface depresses the rubber key, the rubber key is inclined as the back surface is inclined. On the contrary, according to the above configuration, the load is applied only to the central portion of the top face of the rubber key irrespective of the inclination of the back surface of the top key member. Therefore, the rubber key will not be inclined and is depressed without being inclined.

The "central portion" of the top face of the rubber key means a central portion of a top face viewed from the key top member side along the depressing direction. In other words, the central portion of a projection of the top face that is projected on a plane perpendicular to the depressing direction. It should be noted that when the "central portion" or an area in the vicinity of the "central portion" of the top face is depressed along the depressing direction, the rubber key is depressed straightly along the depressing dereliction, without being inclined. An expression that the load is applied to the central portion or to an area in the vicinity of the central portion of the top face from the key top member does not intended to express that the load is applied only to the center or the area in the vicinity of the central portion, but the load is applied at least to the central portion or the area in the vicinity of the central portion so that the rubber key is depressed along the depressing direction without being inclined.

According to the rubber key device configured as above, when the operation face of the key top member (depression area) is depressed and the key top member is rotated, the load from the key top member is applied to the top face of the rubber key at its central portion or the area in the vicinity of the central portion of the top face of the rubber key. Accordingly, the rubber key is depressed straightly in the depressed direction without being inclined. As the rubber key is depressed straightly, the click feel generating mechanism works and generates the necessary click feel. Accordingly, the user can recognize that the key operation is correctly performed, which improves the operability of the rubber key device.

The load transmitting mechanism may be provided on one of the top face of a rubber key and the back side of the key top member at a position corresponding to the rubber key. If the load transmitting mechanism is provided on the top face of the rubber key, even if the positional relationship between the key top member and the rubber key is different from a designed relationship, a relative position between the top face of the rubber key and the load transmitting mechanism does not change, which ensures that the load is applied to the central portion or the area in the vicinity of the central portion of the top face of the rubber key.

The load transmitting mechanism may include a protrusion provided at substantially the center of the top face of each of the multiple rubber keys and protruded toward the back surface of the key top member.

Alternatively, the load transmitting mechanism may include a rib provided at substantially the center of the top face of each of the multiple rubber keys, the rib extending in a direction parallel with the back surface of the key top member and perpendicular to a rotating direction of the top key member.

Further alternatively, the load transmitting mechanism may include a step formed at substantially the center of the top face of each of the multiple rubber keys, the step extending in a direction parallel with the back surface of the key top member and perpendicular to a rotating direction of the top key member.

The top face of each of the multiple rubber keys formed with an upper face and lower face, and the upper face is closer than the lower face to the back surface of the top key member. The step described above is formed between the upper face and the lower face.

With this structure, the strength of the load transmitting mechanism can be increased.

A condition $\alpha<\beta$ may be satisfied, where, $\alpha$ represents a rotation angle at which the key top member is rotated as one of the multiple depression areas is depressed and the corresponding rubber key is depressed, and $\beta$ represents an angle formed between a plane of the back surface of the key top member before being rotated and a plane contacting both an edge of the upper face at the step and an outer end, which is an end opposite to the end at which the step is formed, of the lower face.

Further, each of the upper face and the lower face may have a semicircular shape, and arranged such that a linear side of the upper face meets a linear side of the lower face at the step.

The back surface of the key top member may contact only the load transmitting mechanism.

Each of the multiple rubber keys may be provided with a movable contact at a bottom face thereof, the movable contact contacting a stationary contact provided at a position corresponding to the movable contact when the rubber key is fully depressed.

The click feel generating mechanism may include a skirt portion provided at the bottom end of each rubber key and elastically supports the rubber key.

According to aspects of the invention, there is provided a mobile terminal, which is provided with a case, and a rubber key device.

The rubber key device may include a key top member having an operation face, which is exposed to outside through an opening formed on the case, multiple depression areas to be depressed by a user being defined on the operation face, the multiple depression areas being arranged along a periphery of the operation face, multiple rubber keys arranged below the key top, top faces of the multiple rubber keys facing the back surface of the key top member at positions corresponding to the multiple operation areas, respectively, a click feel generating mechanism provided to each rubber key and configured to generate a click feel in response to depression of each rubber key by a certain degree, and a load transmitting mechanism provided between the back side of the key top member and the top face of each of the multiple rubber keys. When one of the multiple depression areas is depressed by the user, the key top member is rotated about a fulcrum which is defined to be located on center side with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion (i.e., a central portion of an area in the vicinity of the central portion) of the top face of the corresponding one of the multiple rubber keys regardless of the depression amount of the depression area. Each of the multiple rubber keys may be provided with a movable contact at a bottom face thereof, the movable contact contacting a stationary contact provided at a position corresponding to the movable contact when the rubber key is fully depressed.

The mobile terminal may be configured to execute multiple functions, and the multiple functions may be assigned to the multiple depression areas, respectively, the multiple functions being executed in response to depression of the multiple depression areas, respectively.

According to aspects of the invention, there is provided an image processing apparatus capable of executing multiple functions including a function of facsimile transmission/reception and a function of image formation. The image processing apparatus may include a case and a rubber key device. The rubber key device may be provided with a key top member having an operation face, which is exposed to outside through an opening formed on the case, multiple depression areas to be depressed by a user being defined on the operation face, the multiple depression areas being arranged along a periphery of the operation face, multiple rubber keys arranged below the key top, top faces of the multiple rubber keys facing the back surface of the key top member at positions corresponding to the multiple operation areas, respectively, a click feel generating mechanism provided to each rubber key and configured to generate a click feel in response to depression of each rubber key by a certain degree, and a load transmitting mechanism provided between the back side of the key top member and the top face of each of the multiple rubber keys. When one of the multiple depression areas is depressed by the user, the key top member is rotated about a fulcrum which is defined to be located on center side with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion (i.e., a central portion of an area in the vicinity of the central portion)

of the top face of the corresponding one of the multiple rubber keys regardless of the depression amount of the depression area. Each of the multiple rubber keys is provided with a movable contact at a bottom face thereof, the movable contact contacting a stationary contact provided at a position corresponding to the movable contact when the rubber key is fully depressed.

The image processing apparatus may be configured to execute multiple functions, and the multiple functions may be assigned to the multiple depression areas, respectively, the multiple functions being executed in response to depression of the multiple depression areas, respectively.

Embodiments

Referring to the accompanying drawings, a facsimile apparatus according to aspects of the invention will be described.

(1) Entire Configuration of Facsimile Apparatus

Figure 1:
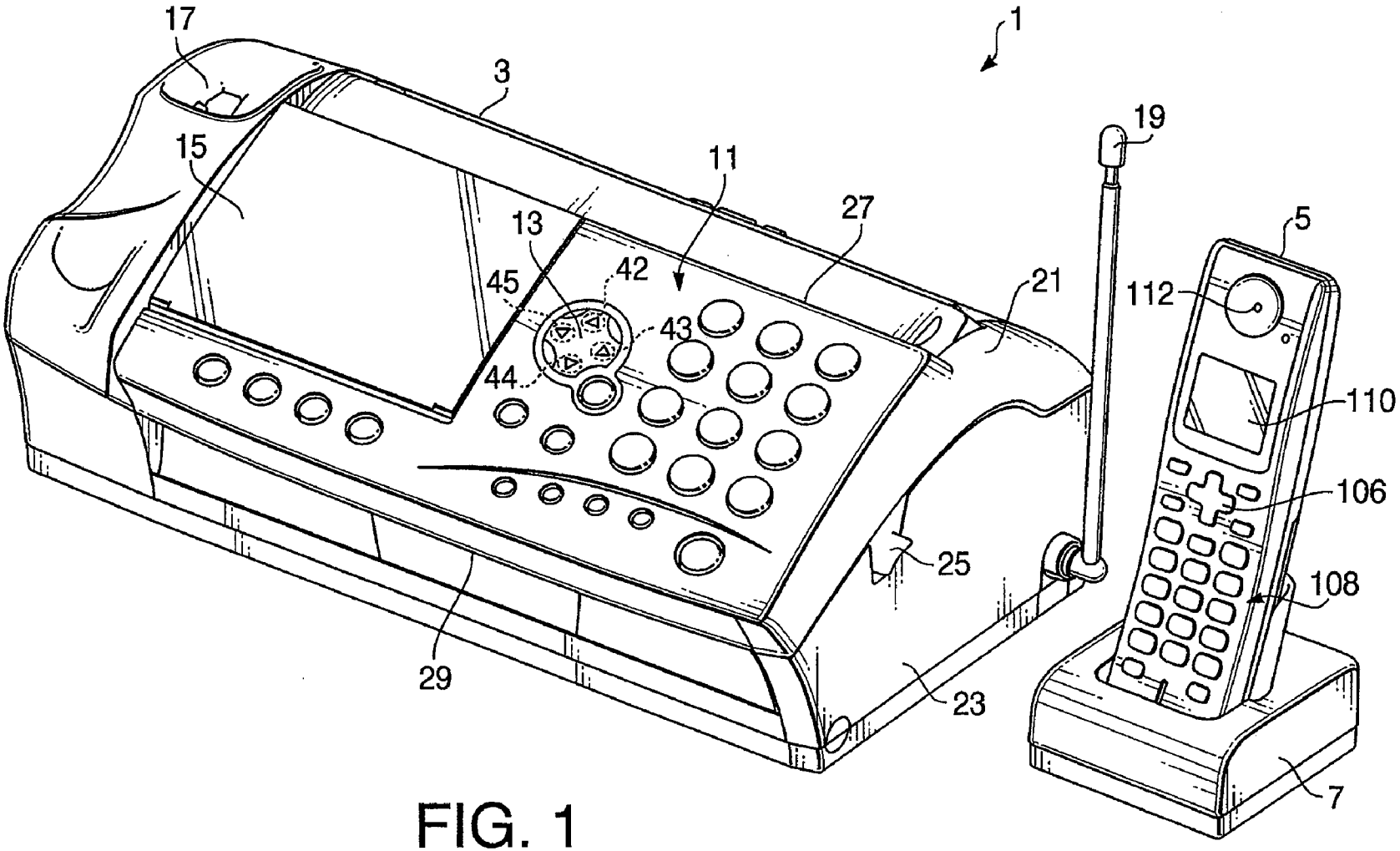
FIG. 1 is a perspective view of a facsimile apparatus according to aspects of the invention.

FIG. 1 is a perspective view of the facsimile apparatus 1 according to aspects of the invention. As shown in FIG. 1, the facsimile apparatus 1 is of a well-known configuration and is provided with a base unit 3 and a cordless handset 5.

The base unit 3 is a communication apparatus having a function of transmitting/receiving facsimile data via a telephone line (not shown) as well as a telephone function with a destination station. The base unit 3 is provided with an operation panel 11 having multiple keys such as ten keys for inputting telephone/facsimile number of a destination station, and a four-direction key 13, a display 15 that displays various pieces of information including an operation status of the facsimile apparatus 1 and telephone/facsimile numbers input by the user, a handset tray on which the handset is placed, and an antenna 19 used for a wireless communication with the cordless handset 5.

The base unit 3 has the telephone (voice communication) function using the handset placed on the handset tray 17, and a basic function as the facsimile apparatus, that is, a function of reading image of an original and a function of recording image on a recording sheet.

The image reading function is to optically read an image formed on an original sheet which is inserted through an original inlet (not shown). Image data is generated with the image reading function is converted into facsimile data, which is transmitted to an external facsimile apparatus via the telephone line. The original sheet after the image reading operation is finished is discharged to a front side of the facsimile apparatus 1 through the original outlet 29.

The image recording function is to form (record) an image represented by facsimile data, which is received from an external facsimile apparatus through the telephone line when the facsimile data is received. The recording sheet on which the image has been formed (recorded) is discharged to a rear side of the facsimile apparatus 1 through the recoding sheet outlet 27.

The four-direction key 13 have a similar function as the four-direction key 106 provided to the cordless handset 100, although the appearances are different. That is, the four-direction key 13 has four depression areas along its periphery. Specifically, the four-direction key 13 is formed to have a cross-shape, and corresponding to its up/down/right/left directions, four depression areas 42, 43, 44 and 45 are assigned.

To each of the depression areas 42, 43, 44 and 45, functions or selective/setting items are assigned, respectively. For example, when a left depression area 45 is depressed, a calling history by the time when the left depression area 45 is depressed is displayed. To the other three depression areas 42, 43 and 44, some functions or selection/setting items are assigned respectively.

The facsimile apparatus 1 is covered with an upper cover 21 and a lower cove 23. Each of the upper and lower covers 21 and 23 is rotatably connected to the facsimile apparatus 1 via a cover rotation shaft (not shown) provided at its rear end side. When the user operates a lever 25 (i.e., lift the same) to open the upper cove 21, the upper cover 21 rotates about the cover rotation shaft. As the upper cover 21 is opened, elements contained therein are exposed to outside, and the user can perform maintenance work for the contained elements.

The cordless handset 5 is a well-known portable terminal for voice communication with the base unit 3 and/or an external device through the telephone line. The function and appearance are substantially similar to those of the conventional cordless handset shown in FIG. 11. Therefore, for the similar elements, the same reference numbers as shown in FIG. 11 are assigned, and description thereof will be omitted for brevity. The base unit 3 operates as receiving a power from an external power supply (a 100V AC power source). The cordless handset 5 operates with power supplied by a built-in battery (secondary battery). Therefore, when the battery is charged, the cordless handset 5 is mounted on a cordless handset charger 7 as shown in FIG. 1.

Figure 2A:
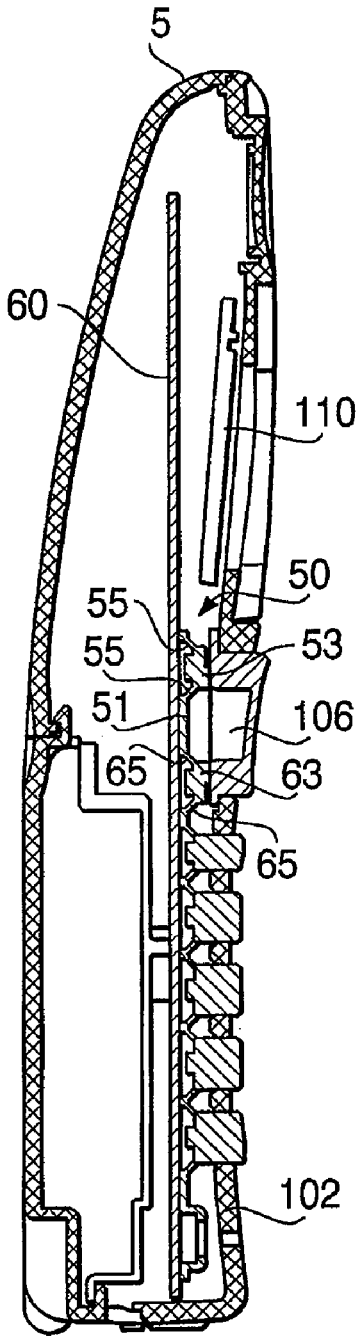
FIG. 2A is a cross-sectional side view of a cordless handset according to aspects of the invention.
Figure 2B:
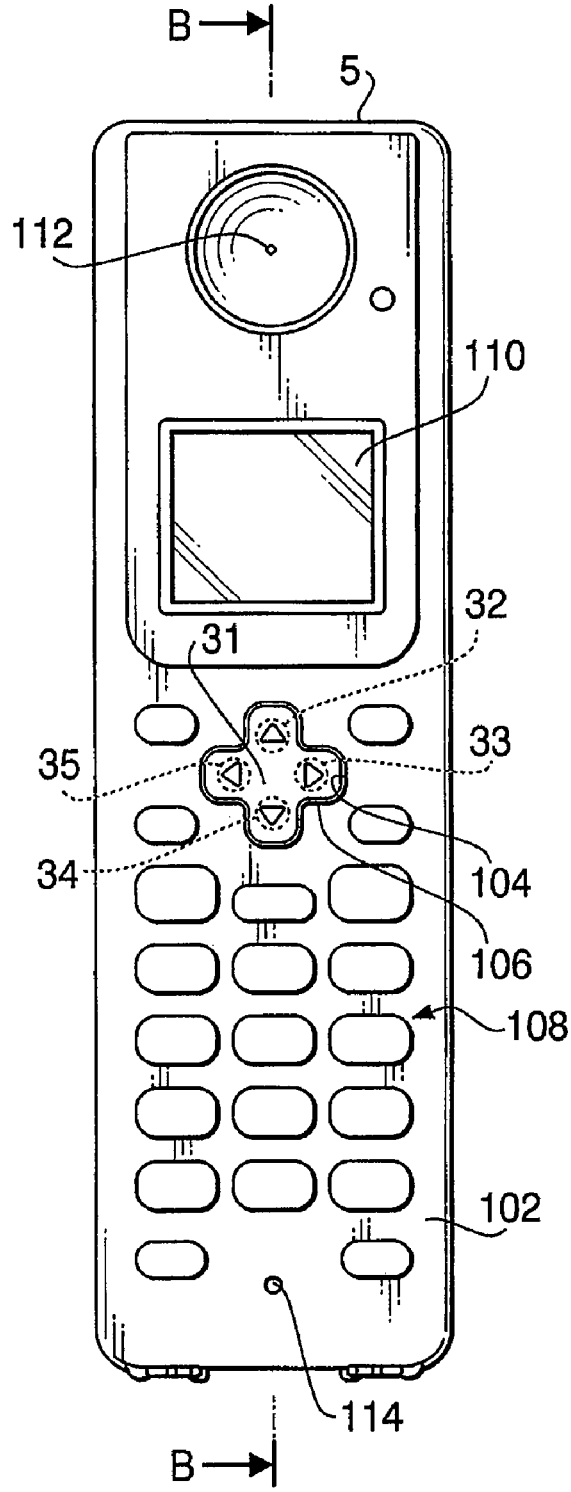
FIG. 2B is a front view of the cordless handset shown in FIG. 2A.

The cordless handset 5 is configured as shown in FIGS. 2A and 2B. FIG. 2A is a cross-sectional side view of the cordless handset 5 taken along line B-B in FIG. 2B, which is a front view of the cordless handset. As shown in FIGS. 2A and 2B, an operation face 31 of the four-direction key 106 of the cordless handset 5 is exposed to outside from an opening 104 formed on a case 102 of the cordless handset 5. The operation face 31 has four depression areas 32, 33, 34 and 35, which are arranged along the periphery of the operation face 31.

To each of the depression areas 32, 33, 34 and 35, a function, a selective item or the like is assigned. Thus, when one of the depression areas 32-35 is depressed, the corresponding function or selective item is selected. For example, by depressing the right depression area 33 or the left depression area 35, ring volume or volume of received voice can be adjusted. Further, by depressing the upper depression area 32, a telephone book data registered with the cordless handset 5 is displayed on the display 110.

On a back side of the operation panel 108, inside the cordless handset 5, a rubber key sheet 50 including multiple rubber keys arranged in correspondence with the keys provided to the operation panel 108 (including the depression areas 32-35 of the four-direction key 106) (see FIG. 2A) is provided. The rubber key sheet 50 is attached on a printed circuit board 60 on which various electronic circuits for driving the cordless handset 5 are formed.

Among the multiple rubber keys of the rubber key sheet 50, the rubber keys other than the for rubber keys 53, 63, 92 and 93 (see FIGS. 2A, 3A and 3B) are exposed to outside through opening formed on the case 102, and are directly operated by the user as numeral keys. For example, if the user depresses the numeral keys (i.e., the corresponding rubber keys are depressed'), then the depressed rubber keys are urged towards the printed circuit board 50. Then, a movable contact formed on a bottom surface of each rubber key contacts a corresponding stationary contact formed on the printed circuit board 60. With this configuration, a user's input operation (i.e., inputting of numerals) is acquired.

Regarding the four rubber keys 53, 63, 82 and 93, they are not exposed to outside, but the four-direction key 106 is mounted on those rubber keys 53, 63, 82 and 93 as shown in FIG. 2A.

Figure 3A:
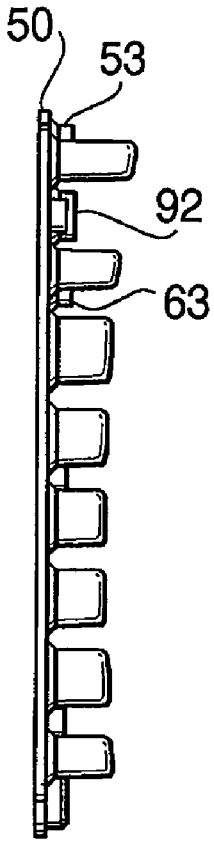
FIG. 3A is a side view of a rubber key sheet according to aspects of the invention.
Figure 3B:
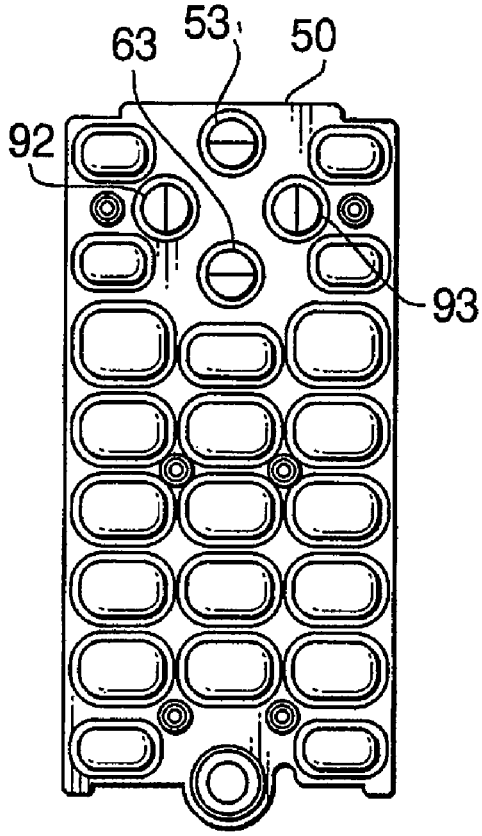
FIG. 3B is a front view of the rubber key shown in FIG. 3A.

FIGS. 3A and 3B show structure of the rubber key sheet 50. FIG. 3A is a side view and FIG. 3B is a front view of the rubber key sheet 50. As shown in FIGS. 2A, 2B, 3A and 3B, the rubber keys 53, 63, 92 and 93 arranged below (on the left-hand side in FIG. 2A) the four-direction key 106 correspond to the four depression areas 32, 33, 34 and 35, respectively.

Each of the rubber keys 53, 63, 92 and 93 is, similar to the rubber key 123 shown in FIG. 11, connected to a base via a skirt portion. Specifically, the rubber key 53 arranged to face the back surface of the depression area 32, which corresponds to the upper area of the four-direction key 106, is connected to a base portion 51 via a skirt portion 55 formed around the lower end of the bottom portion of the rubber key 53. The rubber key 63 arranged to face the back surface of the depression area 34, which corresponds to the lower area of the four-direction key 106, is connected to the base portion 51 via a skirt portion 65 formed around the lower end of the bottom portion of the rubber key 63. The rubber keys 92 and 93 have the similar structure.

Figure 11A:
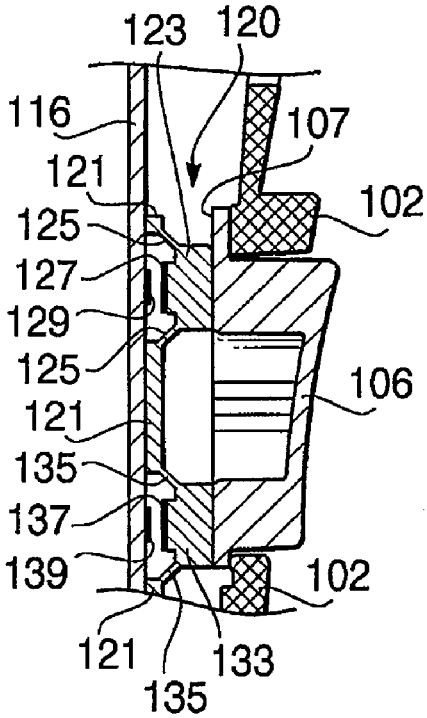
FIG.11A PRIOR ART
FIGS. 11A and 11B schematically show a structure of a rubber key device employed in the cordless handset according to aspects of the invention.
Figure 11B:
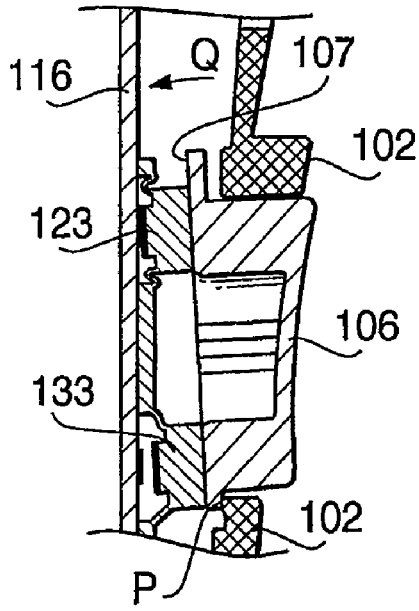
FIG.11B PRIOR ART

The skirt portions 55 and 65 are similar to the skirt portions 125 and 135 shown in FIGS. 11A and 11B, and are for generating a "click" feel when the user depresses the four-direction key 106. That is, when the user apply a depressing force, for example, to the depression area 32 therefore to the rubber key 53 in a direction perpendicular to a plane of the printed circuit board 60, the skirt portion 55 resists the force to remain its shape when the applied force is smaller than a certain force. However, as the force increases and exceeds the certain forces, the skirt portion 55 elastically deforms to bend abruptly. Due to this structure, there occurs a change before and after the applied load exceeds the certain amount, which change provides the user with the "click" feel.

Figure 10:
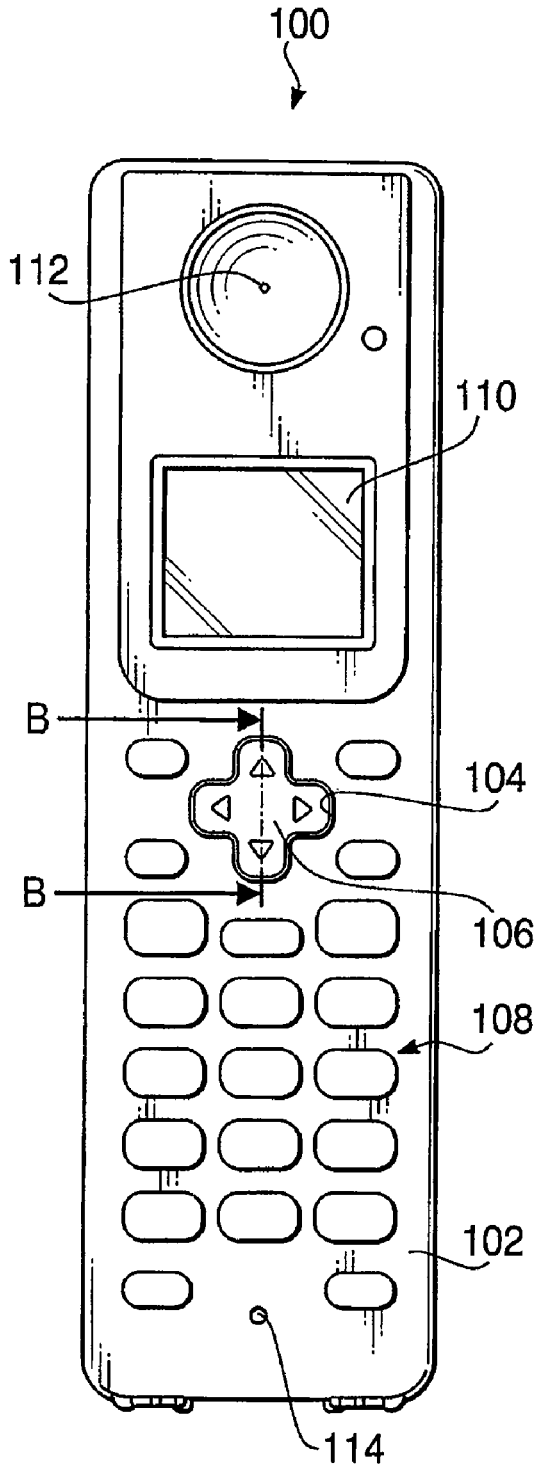
FIG. 10 is a front view of the cordless handset according to aspects of the invention.

As above, the cordless handset 5 has substantially the same structure as the conventional cordless handset 100 shown in FIGS. 10, 11A and 11B, and has the same function. The difference between the cordless handset 5 according to the aspects of the invention is different from the conventional cordless handset 100 by the shape of upper faces of the four rubber keys 53, 63, 92 and 93 facing the bottom surface of the four-direction key 106.

Hereinafter, the structure of the four rubber keys 53, 63, 92 and 93 (in particular, the structure of the rubber keys 53 and 63 corresponding to the upper and lower directions of the four-direction key 106) will be described in detail.

Structures of Rubber Keys Corresponding to Four-Direction Key

Figure 4A:
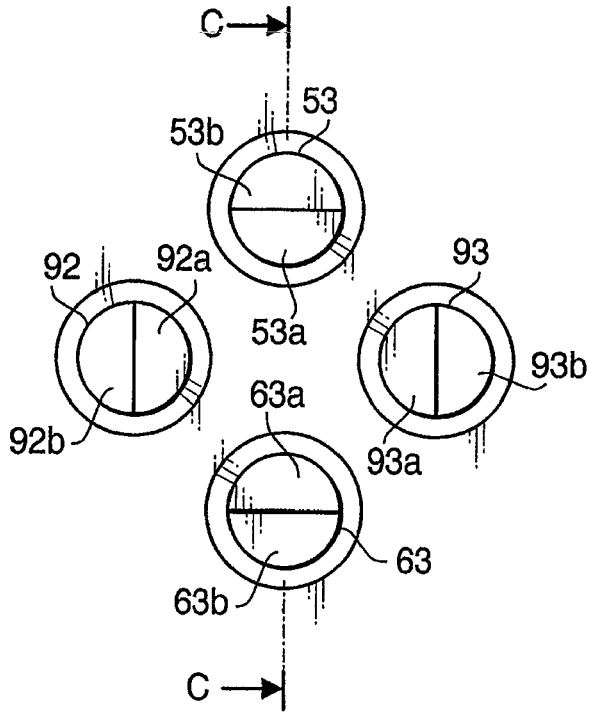
FIG. 4A is an enlarged front view showing a configuration of a rubber key according to aspects of the invention.
Figure 4B:
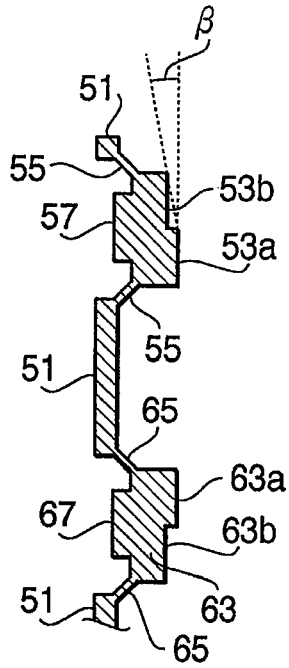
FIG. 4B is a cross-sectional side view of the rubber key shown in FIG. 4A.

FIGS. 4A and 4B show the four rubber keys 53, 63, 92 and 93, which correspond to the four-direction key 106.

As shown in FIGS. 4A and 4B, an upper face (which faces the back surface 107 of the four-direction key 106) of each of the four rubber keys 53, 63, 92 and 93 formed on the rubber key sheet 50 has an upper face and a lower face, each having a semicircle shape. The lower face is farther from the back surface 107 of the four-direction key 106 than the upper face.

Specifically, the rubber key 53, which faces the back surface of the upper depression area 32 of the four-direction key 106, is configured to have an upper face 53*a* and a lower face 53*b*, each having a semicircle shape. The upper face 53*a* is formed such that an arc portion of its outline is oriented toward centers of the four rubber keys 53, 63, 92 and 93 (in other words, toward the center of the four-direction key 106). The lower face 53*b* is formed such that an arc portion of its peripheral is oriented toward a direction opposite to the center of the four-direction key 106.

In FIG. 4B, a positional relationship in the height direction (i.e., a direction perpendicular to a plane of the printed circuit board 60) between the upper face 53*a* and the lower face 53*b* is shown. The lower face 53*b* is slightly lower than the upper face 53*a* in the height direction. That is, a surface of the rubber key 53 facing the back surface 107 of the four-direction key 106 is formed to have a step (between the upper face 53*a* and the lower face 53*b*).

Figures 6A, 6B:
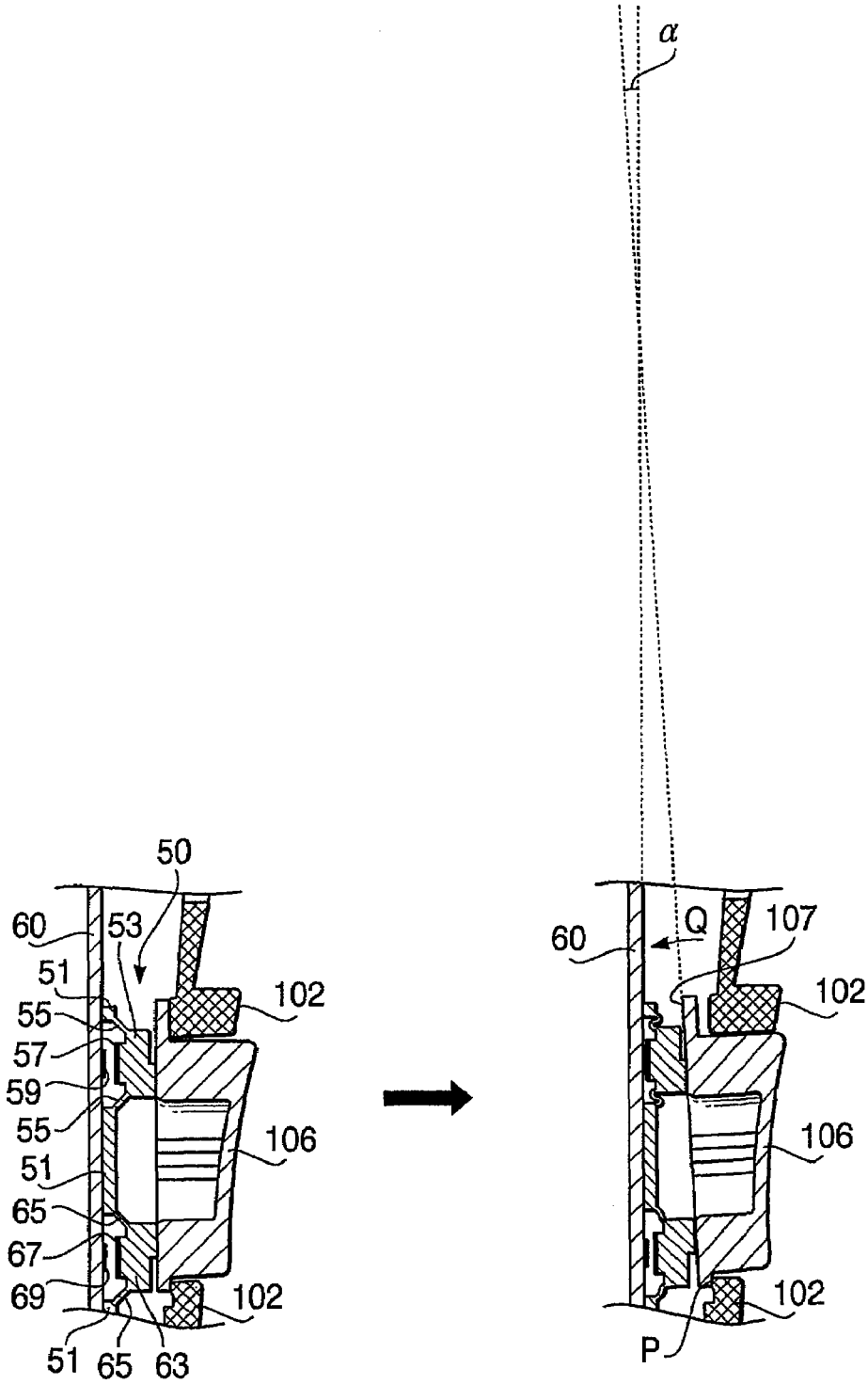
FIGS. 6A and 6B are cross-sectional side views of the rubber key device, showing deformation of the rubber key when the four-direction key is depressed.

Specifically, the step is formed such that an angle β formed by a line connecting a center of a linear portion of the periphery of the upper face 53*a* and the arc portion of the periphery of the lower face 53*b* with respect to the back surface 107 of the four-direction key 106 before the four-direction key 106 is rotated (i.e., when the four-direction key 106 is in its neutral state) is greater than a rotating angle α when the four-direction key 106 is depressed to rotate (see FIG. 6B).

The rubber key 63 provided to face the back surface of the lower depression area 34 of the four-direction key 106 has the similar structure, and has an upper face 63*a* and a lower face 63*b*, each having a semicircle shape. The upper face 63*a* is oriented such that the arc portion of the periphery is directed to the center of the four-direction key 106, while the lower face 63*b* is oriented that the arc portion of its periphery is directed in a direction opposite to the center of the four-direction key 106. The other two rubber keys 92 and 93 have the similar structure.

Thus, in summary, the arc portion of the periphery of each of the upper faces 53*a*, 63*a*, 92*a* and 93*a* each having a semicircular shape faces the center of the four-direction key 106, and the each of the lower faces 53*b*, 63*b*, 92*b* and 93*b* is oriented in the opposite direction with respect to the corresponding upper face. On the bottom faces (which face the printed circuit board 60) of the rubber keys 53 and 63, movable contacts 57 and 63 formed with thin-layered carbon is provided. Similarly, on the bottom faces (which face the printed circuit board 60) of the rubber keys 92 and 93, movable contacts (not shown) formed with thin-layered carbon is provided.

Figure 5A:
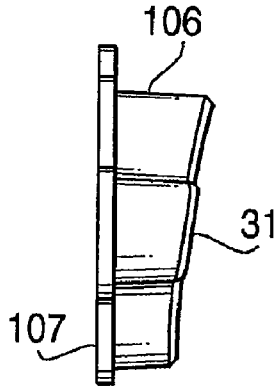
FIG. 5A is a side view of a four-direction key according to aspects of the invention.
Figure 5B:
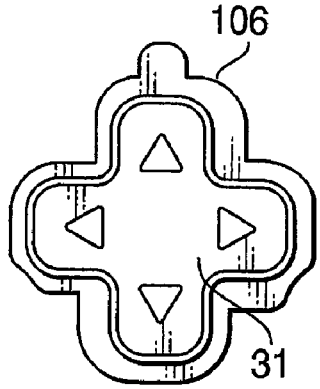
FIG. 5B is a front view of the four-direction key shown in FIG. 5A.
Figure 5C:
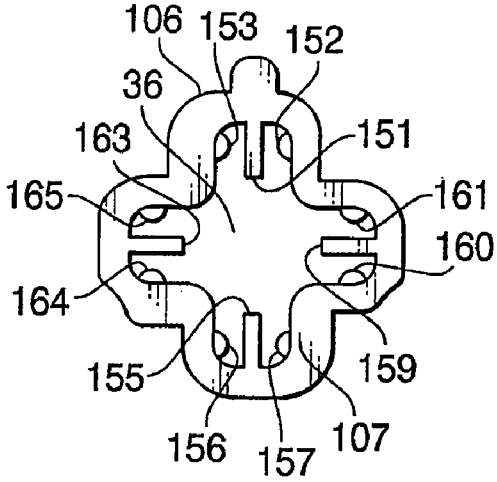
FIG. 5C is a bottom view of the four-direction key seen from the bottom thereof.
Figure 5D:
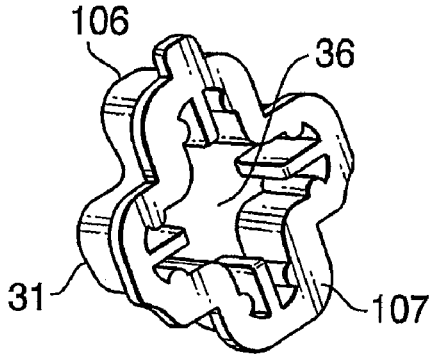
FIG. 5D is a perspective view of the four-direction key showing the bottom surface thereof.

FIGS. 5A-5D show the structure of the four-direction key 106 in detail. FIG. 5A is a side view, FIG. 5B is a front view, FIG. 5C is a rear view and FIG. 5D is a perspective view viewed from the rear side. The four-direction key 106 is made of resin by molding. As shown in FIGS. 5A-5D, the height of the operation face from the back surface 107 is gradually increases from the lower side depression area 34 to the upper side depression area 32.

As shown in FIGS. 5C and 5D, the four-direction key 106 is hollowed from its rear side 107. Specifically, on the back sides of the depression areas 32, 33, 34 and 35, a plurality of ribs are formed. As shown in FIGS. 5C and 5D, on the rear side of the upper depression area 32, three ribs 151, 152 and 153 are formed. On the rear side of the right depression area 33, three ribs 163, 164 and 165 are formed. On the rear side of the lower depression area 34, three ribs 155, 156 and 157 are formed, and the rear side of the left depression area 35, three ribs 159, 160 and 161 are formed. The reason why the four-direction key 106 is not evenly hollowed, but the ribs are formed is to ensure that a sufficient load for depression is applied by the back side 107 of the four-direction key 106 to the four rubber keys 53, 63, 92 and 93.

Operation of Rubber Keys Depressed by Four-Direction Key

Next, status change of each of the rubber keys 53, 63, 92 and 93 when depressed by the four-direction key 106 will be described with reference to FIGS. 6A and 6B. It should be noted that the changes of the status when the rubber keys 53, 63, 92 and 93 are depressed by the four-direction key 106 are the same, a case where the rubber key 53 is depressed by the four-direction key 106 (depression area 32) will be described, and the others will be omitted for brevity.

FIGS. 6A and 6B are cross-sectional side views of the rubber key 53 and the corresponding part of the four-direction key 106. When the four-direction key 106 is in the neutral state (i.e., when the depression area 32 of the four-direction key 106 is not depressed by the user), as shown in FIG. 6A, the rubber key 42 is elastically supported by the skirt portion 55. In this status, the upper face 53*a* contacts the back side 107 of the four-direction key 106. At this stage, the skirt portion 55 is not deformed.

As the upper depression area 32 is depressed by the user downward (in the left-hand side direction in FIGS. 6A and 6B), as shown in FIG. 6B, the four-direction key 106 gradually rotates about a fulcrum P which is a contacting point where an end opposite to the depressed depression area (i.e., 32) with respect to the center of the four-direction key 106 counterclockwise in FIG. 6B (i.e., in a direction indicated by arrow Q). Then, by the backside 107 of the four-direction key 106, the rubber key 53 is depressed.

During the above depressing operation, the back side 107 of the four-direction key 106 gradually inclines as it rotates about the fulcrum P as is understood by comparing FIG. 6B with FIG. 6A. Due to the inclining movement, the back surface 107 contacts the linear portion of the upper face 53*a*. Accordingly, the load of the depression is applied to the linear portion. Specifically, the back surface 107 including the three ribs 121, 122 and 123 (see FIG. 5C) contacts the linear portion (i.e., the ribs 121, 122 and 123 make a linear contact with the linear portion of the upper face 53*a*.

Since the load is applied to the linear portion of the upper face 53*a*, the load is transmitted and applied to the central area of the rubber key 53. Therefore, the rubber key 53 is depressed without being inclined (i.e., maintaining the upper face 53*a* and lower face 53*i*parallel with the plane of the printed circuit board 60) by the back surface 107 of the four-direction key 106.

Therefore, to the skirt portion 55 supporting the rubber key 53, the load is evenly applied. When the applied load reaches a certain level, the skirt portion 55 elastically deforms, substantially evenly as shown in FIG. 6B. With this even deformation, the excellent "click" feeling can be realized.

As the rubber key 53 is straightly (orthogonally to the plane of the printed circuit board 60), the movable contact formed on the bottom surface of the rubber key 53 makes a face contact with respect to the stationary contact 59 formed on the corresponding portion of the printed circuit board 60. Therefore, the electrical contacts therebetween is assured.

When the user fully depresses the upper depression area 33, thus the back surface 107 fully presses down the rubber key 53, the back surface 107 only contacts the linear portion of the upper face 53*a*. This is because the rotation angle α when the four-direction key 106 is fully depressed is smaller than the inclination angle β described above (see FIG. 4B). Since the rubber key 54 has such a structure, the load applied by the four-direction key 106 is only applied to the linear peripheral portion of the upper face 53*a*.

According to the facsimile apparatus 1 configured as above, the cordless handset 5 is provided with a rubber key device including the four-direction key 106 and four rubber keys 53, 63, 92 and 93. When one of the for depression areas (e.g., the upper direction area 32) is depressed, the back surface 107 of the four-direction control key 106 contacts the linear portion of the periphery of the upper face 53*a* and the depression force is applied from the back surface 107 to the linear portion of the periphery of the upper face 53*a*. With this configuration, the load is applied downward.

Although the back surface 107 of the four-direction key 107 inclines with respect to the moving direction of the rubber key 53, with the above structure, the rubber key 53 is depressed and moves in the direction orthogonal to the plane of the printed circuit board 60 without being inclined. Accordingly, the user can obtain the excellent "click" feel. Because of the "click" feel, the user can confirm that the four-direction key 106 is operated clearly. Therefore, with the above-described structure, the operability is well improved. Further, it is ensured that the movable contact formed on the bottom surface of the rubber key 53 makes a surface contact with the stationary contact 59 formed on the printed circuit board 69. Therefore, electrical connection therebetween is ensured.

When the rubber key 53 is being depressed as the load is applied from the four-direction key 106, even if the rotation angle α is smaller than the inclination angel β, the back surface 107 always contacts linear portion of the upper face 53*a*.

Therefore, it is ensured that the load from the four-direction key 106 is applied to the central portion of the rubber key 53. Thus, the user can move the rubber key 53 downward by depressing the four-direction key 106, and the well "click" feel is obtained.

In the relatively small portable terminal such as the cordless handset 5, the rotation angle α when the four-direction key 106 is operated tends to become large. Even in a device in which the rotation angle α is large, by employing the structure of the rubber key device described above, it becomes possible to depress the rubber key straightly downward and the "click" feel can be generated, which improves the operability of the device.

In the foregoing description, the four-direction key 106 of the cordless handset 5 and the rubber keys 53, 63, 92 and 93 are described. It should be noted that the main unit 3 of the facsimile apparatus 1 is also provided with a four-direction key 13, which employs the similar structure. That is, on the backside of the four-direction key 13 of the main unit 3, for rubber keys are provided corresponding to four depression areas 42, 43, 44 and 45. The rubber keys of the main unit are formed to have the similar structure of the rubber keys 53, 63, 92 and 93 of the cordless handset 5. Therefore, in the main unit 3, when the four-direction key 13 is operated, excellent "click" feel is obtained.

It should be noted that the invention needs not be limited to the above-described illustrative embodiment. Various modifications of the above-described embodiments can be made according to aspects of the invention.

In the rubber key device provided to the cordless handset 5, the upper face, which faces the back surface 107 of the four-direction key 106, of each rubber key is formed to have a step and the back surface 107 contacts the linear portion (i.e., the edge of the stepped portion) when the four-direction key 106 is depressed so that each of the rubber keys 53, 63, 92 and 93 can be depressed without being inclined when the upper face thereof is depressed by the back surface 107.

The above structure is employed so that the load is applied to the central portion of the upper face of the rubber key. In other words, if the load is applied to the central portion of the upper face of the rubber key regardless of the degree of depression of the four-direction key, any other configuration would be employed. FIGS. 7A, 7B, 8A, 8B and 9 shows modifications according to such a structure.

Figure 7A:
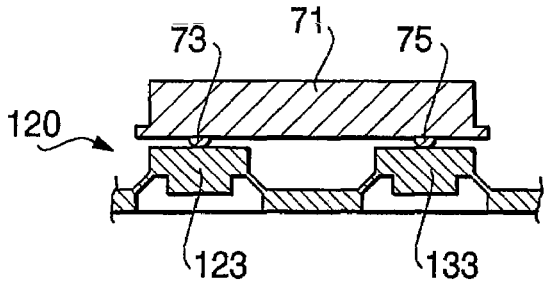
FIG. 7A is a cross-sectional side view of a modified rubber key device according to aspects of the invention.
Figure 7B:
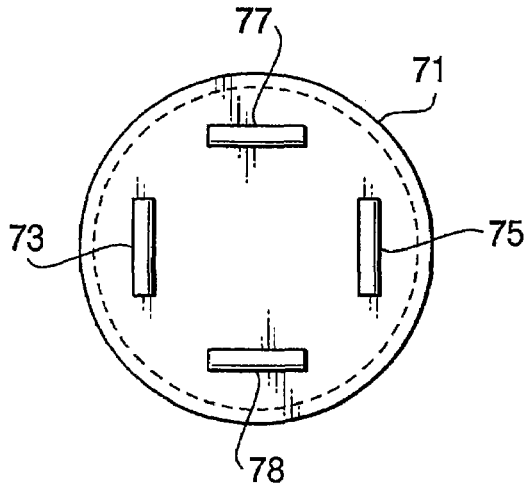
FIG. 7B shows a bottom view of the four-direction key shown in FIG. 7A.
Figure 7C:
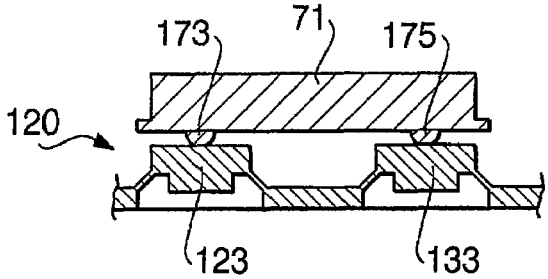
FIG. 7C is a cross-sectional side view of another modified rubber key device according to aspects of the invention.
Figure 7D:
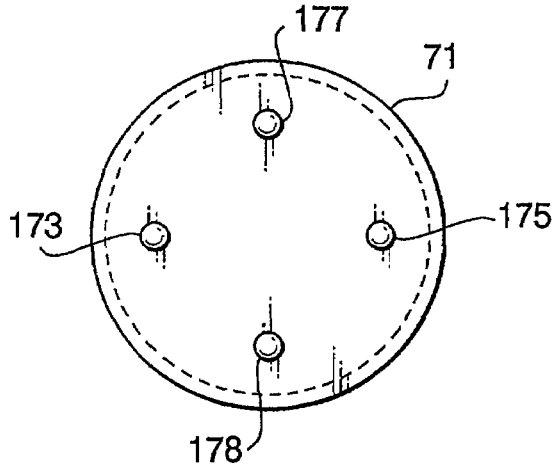
FIG. 7D shows a bottom view of the four-direction key shown in FIG. 7C.

FIGS. 7A and 7B shows a rubber key device configured such that, on the back surface of the four-direction key 71 at portions facing the upper faces of rubber keys 123 and 133, ribs 73 and 71 are formed (see FIGS. 7A and 7B). Ribs 77 and 78 are also formed corresponding to the other rubber keys which are not shown in FIG. 7A. Each rib may have a cylindrical shape. In this modification, the upper face of each rubber key 123 and 133 is formed as a planar circular surface and no steps are formed.

When a depression area of the four-direction key 71 corresponding to the rubber key 123 is depressed to depress the rubber key 123, the rib 73 contacts the upper face of the rubber key 123. The rib 73 may be formed to have a length same as the diameter of the upper face of the rubber key 123, and makes a line contact with the upper face of the rubber key 123.

Then, the load applied to the central portion of the rubber key 123, and the rubber key 123 is depressed without being inclined. Therefore, by forming ribs on the back surface of the four-direction key 71, each rubber key can be depressed in a direction orthogonal to the printed circuit board, and the excellent "click" feel can be obtained.

Figure 8A:
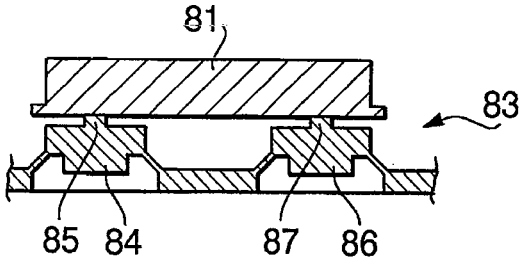
FIG. 8A is a cross-sectional side view of another modification of a rubber key device according to aspects of the invention.
Figure 8B:
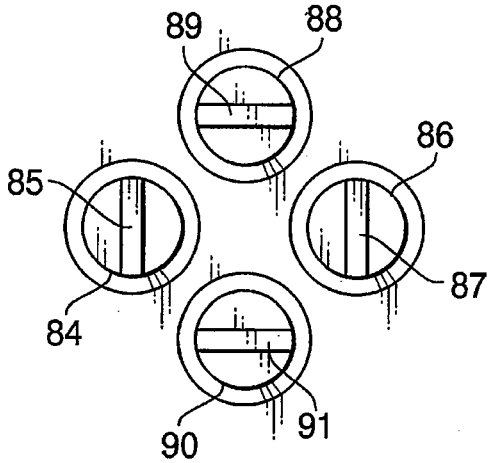
FIG. 8B shows a front view of the rubber key shown in FIG. 8A.
Figure 8C:
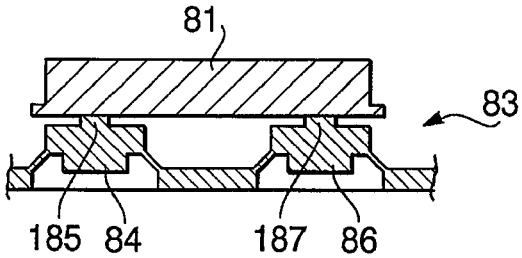
FIG. 8C is a cross-sectional side view of another modification of a rubber key device according to aspects of the invention.
Figure 8D:
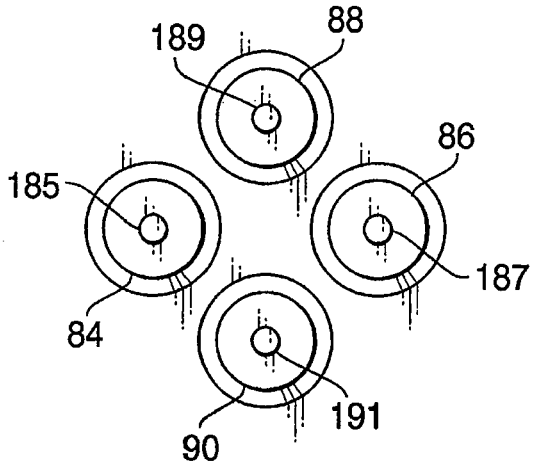
FIG. 8D shows a front view of the rubber key shown in FIG. 8C.

It is appreciated that the ribs need not always be formed on the four-direction key. FIGS. 8A and 8B show a configuration in which the no ribs are formed on the back surface of the four-direction key 81, and rib portions 85, 87, 89 and 91 are formed on upper faces of four rubber keys 84, 86, 88 and 90 which respectively face four depression areas of the four-direction key 81. According to this structure, when a depression area is depressed, the back surface corresponding to the depressed depression area is moved downward and makes a line contact with the edge of the rib portion. For example, when the left-hand side portion in FIG. 8A of the four-direction key 81 is depressed, the back surface of the four-direction key 81 makes the line contact with the left-hand side edge of the rib portion 85 provided on the upper face of the rubber key 84.

With the above structure, when the four-direction key is depressed, the load is applied to the substantially central portion of the upper face of the rubber key 84. Therefore, the rubber key 84 is depressed straightly, without being inclined. Accordingly, the excellent "click" feel can be obtained according to this structure.

In each of the modifications shown in FIGS. 7A and 7B and in FIGS. 8A and 8B, the load can be applied to the central portion of the upper face of each rubber key. However, the structure shown in FIGS. 8A and 8B is preferable.

According to the structure shown in FIGS. 8A and 8B, regardless of the positional relationship between the four-direction key and each rubber key, it is ensured that the back surface makes a line contact with the rib formed on the upper face of the rubber key, and thus it is ensured that the load is applied to the central portion of the rubber key. Accordingly, it is also ensured that the rubber key can be depressed without being inclined.

It should be noted that the ribs 73-79 and 85-91 in the modifications shown in FIGS. 7A, 7B, 8A and 8B, the ribs may be replaced with protrusions 173-179 and 185-191, respectively, as shown in FIGS. 7C, 7D, 8C and 8D. Each of the ribs is elongated to correspond to a diameter of the top face of the rubber key. Each protrusion may be a cylindrical or conical protrusion which may have a rounded tip end provided at the position corresponding to the center of the upper face of the rubber key.

In the above-described illustrative embodiment, the four-direction key 106 is mounted on the four rubber keys 53, 63, 92 and 93. Thus, when one of the depression areas is depressed, a portion of the four-direction key 106 opposite to the depressed area contacts the case 102 serves as the fulcrum P, about which the four-direction key rotates as shown in FIG. 6B. It should be noted that such a structure is only an exemplary structure. FIG. 9 shows another structure of the four-direction key device. According to the structure shown in FIG. 9, a boss (or a supporting shaft) 97 is formed to extend in a direction orthogonal to the plane of the base portion 51, and the center of the four-direction key 95 is rotatably supported by the tip of the boss 97.

According to the structure shown in FIG. 9, the one of the depression areas (e.g., the left-hand side depression area corresponding to the rubber key 53) is depressed, the four-direction key 95 rotates about the central portion at which the four-direction key 95 is supported by the boss 97. Even in such a structure of the four-direction key 95, the structures between the lower surface and the upper face of each rubber key described above can be employed.

In the above-described embodiment, the load from the four-direction key 106 is applied to the center of each rubber key. It should be noted that the portion to which the load is applied need not be an exact center of the upper face. Even if the position to which the load is applied is shifted from the center of the upper face of the rubber key, given that the skirt portions deform substantially uniformly, the excellent "click" effect can be obtained.

In the illustrative embodiment, the rubber key according to aspects of the invention is applied to the facsimile apparatus 1 (including the base unit 4 and the cordless handset 5). However, it should be appreciated that the invention can be applied to any other suitable devices.

Further, the four-direction key is only an example, and the number of depression areas should not be limited to four.

What is claimed is:

1. A rubber key device for an apparatus having a case, comprising:

a key top member having an operation face, which is exposed to outside through an opening formed on the case, multiple depression areas to be depressed by a user, the multiple depression areas being defined on the operation face and arranged along a periphery of the operation face;

multiple rubber keys arranged below the key top member, top faces of the multiple rubber keys facing a back surface of the key top member at positions corresponding to the multiple operation areas, respectively;

a click feel generating mechanism provided to each rubber key and configured to generate a click feel in response to depression of each rubber key by a certain degree; and a load transmitting mechanism provided between the back surface of the key top member and the top face of each of the multiple rubber keys, wherein, when one of the multiple depression areas is depressed by the user, the key top member rotates about a fulcrum at an opposing end of the key top member with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion of the top face of the corresponding one of the multiple rubber keys regardless of the depression amount of the depression, area, wherein the load transmitting mechanism includes a step defined by an upper face and a lower face, the upper face being closer than the lower face to the back surface of the top key member, the step being located at substantially the center of the top face of each of the multiple rubber keys, the upper face being arranged on a central portion of the multiple rubber keys, the lower face being arranged on a side opposing to the central portion and an outer side of the rubber key on which the step is formed, wherein a condition $\alpha<\beta$ is satisfied, where $\alpha$ represents a rotation angle at which the key top member is rotated about the fulcrum as one of the multiple depression areas is depressed and the corresponding rubber key is depressed, and $\beta$ represents an angle formed between a plane of the back surface of the key top member before being rotated and a plane contacting both an edge of the upper face at the step and an outer end, which is an end opposite to the end at which the step is formed, of the lower face, and, wherein each of the upper face and the lower face is semicircular shape viewed in a direction perpendicular to the upper face, a linear side of the semicircular upper face meeting a linear side of the semicircular lower face at the step.

2. The rubber key device according to claim 1, wherein the load transmitting mechanism is formed on the top face of each of the multiple rubber keys.

3. The rubber key device according to claim 1, wherein the back surface of the key top member contacts only the load transmitting mechanism.

4. The rubber key device according to claim 1, wherein the load transmitting mechanism is provided on one of the top face of a rubber key and the back side of the key top member at a position corresponding to the rubber key.

5. The rubber key device according to claim 1, wherein each of the multiple rubber keys is provided with a movable contact at a bottom face thereof, the movable contact contacting a stationary contact provided at a position corresponding to the movable contact when the rubber key is fully depressed.

6. The rubber key device according to claim 1, wherein the click feel generating mechanism includes a skirt portion provided at the bottom end of each rubber key and elastically supports the rubber key.

7. A mobile terminal, comprising:

a case; and a rubber key device, the rubber key device including:

a key top member having an operation face, which is exposed to outside through an opening formed on the case, multiple depression areas to be depressed by a user, the multiple depression areas being defined on the operation face and arranged along a periphery of the operation face;

multiple rubber keys arranged below the key top member, top faces of the multiple rubber keys facing a back surface of the key top member at positions corresponding to the multiple operation areas, respectively;

a click feel generating mechanism provided to each rubber key and configured to generate a click feel in response to depression of each rubber key by a certain degree; and a load transmitting mechanism provided between the back surface of the key top member and the top face of each of the multiple rubber keys, wherein when one of the multiple depression areas is depressed by the user, the key top member rotates about a fulcrum at an opposing end of the key top member with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion of the top face of the corresponding one of the multiple rubber keys regardless of the depression amount of the depression area, wherein the load transmitting mechanism includes a step defined by an upper face and a lower face, the upper face being closer than the lower face to the back surface of the top key member, the step being located at substantially the center of the top face of each of the multiple rubber keys, the upper face being arranged on a central portion of the multiple rubber keys, the lower face being arranged on a side opposing to the central portion and an outer side of the rubber key on which the step is formed, wherein a condition $\alpha<\beta$ is satisfied, where $\alpha$ represents a rotation angle at which the key top member is rotated about the fulcrum as one of the multiple depression areas is depressed and the corresponding rubber key is depressed, and $\beta$ represents an angle formed between a plane of the back surface of the key top member before being rotated and a plane contacting both an edge of the upper face at the step and an outer end, which is an end opposite to the end at which the step is formed, of the lower face, and wherein each of the upper face and the lower face is semicircular shape viewed in a direction perpendicular to the upper face, a linear side of the semicircular upper face meeting a linear side of the semicircular lower face at the step.

8. The mobile terminal according to claim 7, wherein the mobile terminal is capable of executing multiple functions, and wherein the multiple functions are assigned to the multiple depression areas, respectively, the multiple functions being executed in response to depression of the multiple depression areas, respectively.

9. The mobile terminal according to claim 7, wherein the load transmitting mechanism is formed on the top face of each of the multiple rubber keys.

10. The mobile terminal according to claim 7, wherein the back surface of the key top member contacts only the load transmitting mechanism

11. The mobile terminal according to claim 7, wherein the load transmitting mechanism is provided on one of the top face of a rubber key and the back side of the key top member at a position corresponding to the rubber key.

12. An image processing apparatus capable of executing multiple functions including a function of facsimile transmission/reception and a function of image formation, the image processing apparatus, comprising:

a case; and a rubber key device, the rubber key device comprising:

a key top member having an operation face, which is exposed to outside through an opening formed on the case, multiple depression areas to be depressed by a user, the multiple depression areas being defined on the operation face and arranged along a periphery of the operation face;

multiple rubber keys arranged below the key top member, top faces of the multiple rubber keys facing a back surface of the key top member at positions corresponding to the multiple operation areas, respectively;

a click feel generating mechanism provided to each rubber key and configured to generate a click feel in response to depression of each rubber key by a certain degree; and a load transmitting mechanism provided between the back surface of the key top member and the top face of each of the multiple rubber keys, wherein when one of the multiple depression areas is depressed by the user, the key top member rotates about a fulcrum at an opposing end of the key top member with respect to the depressed depression area, the rubber key corresponding to the depressed depression area being depressed by the back surface of the key top member at a position corresponding to the depressed depression area with the load transmitting mechanism provided therebetween, the load transmitting mechanism transmitting the load caused by the depression of the depression area to the top face of the corresponding one of the multiple rubber keys such that the load is transmitted to only a substantially central portion of the top face of the corresponding one of the multiple rubber keys regardless of the depression amount of the depression area, wherein the load transmitting mechanism includes a step defined by an upper face and a lower face, the upper face being closer than the lower face to the back surface of the top key member, the step being located at substantially the center of the top face of each of the multiple rubber keys, the upper face being arranged on a central portion of the multiple rubber keys, the lower face being arranged on a side opposing to the central portion and an outer side of the rubber key on which the step is formed, wherein a condition $\alpha<\beta$ is satisfied, where $\alpha$ represents a rotation angle at which the key top member is rotated about the fulcrum as one of the multiple depression areas is depressed and the corresponding rubber key is depressed, and $\beta$ represents an angle formed between a plane of the back surface of the key top member before being rotated and a plane contacting both an edge of the upper face at the step and an outer end, which is an end opposite to the end at which the step is formed, of the lower face, and wherein each of the upper face and the lower face is semicircular shape viewed in a direction perpendicular to the upper face, a linear side of the semicircular upper face meeting a linear side of the semicircular lower face at the step.

13. The image processing apparatus according to claim 12, wherein the image processing apparatus is capable of executing multiple functions, and wherein the multiple functions are assigned to the multiple depression areas, respectively, the multiple functions being executed in response to depression of the multiple depression areas, respectively.

14. The image processing apparatus according to claim 12, wherein the load transmitting mechanism is formed on the top face of each of the multiple rubber keys.

15. The image processing apparatus according to claim 12, wherein the back surface of the key top member contacts only the load transmitting mechanism.

16. The image processing apparatus according to claim 12, wherein the load transmitting mechanism is provided on one of the top face of a rubber key and the back side of the key top member at a position corresponding to the rubber key.

* * * * *